US007308877B2

(12) United States Patent
Izumi et al.

(10) Patent No.: US 7,308,877 B2
(45) **Date of Patent: *Dec. 18, 2007**

(54) VARIABLE VALVE TIMING CONTROLLER FOR INTERNAL COMBUSTION ENGINE

(75) Inventors: Kazunari Izumi, Kariya (JP); Haruyuki Urushihata, Chiryu (JP)

(73) Assignee: Denso Corporation, Kariya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/213,900

(22) Filed: Aug. 30, 2005

(65) Prior Publication Data

US 2006/0042579 A1 Mar. 2, 2006

(30) Foreign Application Priority Data

Aug. 31, 2004 (JP) ..... 2004-253176

(51) Int. Cl.
*F01L 1/34* (2006.01)

(52) U.S. Cl. ..... 123/90.17; 123/90.15; 123/90.16; 123/90.31; 123/90.11

(58) Field of Classification Search ..... 123/90.17
See application file for complete search history.

(56) References Cited

U.S. PATENT DOCUMENTS 3,978,829 A * 9/1976 Takahashi et al. ..... 123/90.15
6,405,694 B2 6/2002 Sato
7,059,285 B2 * 6/2006 Schafer et al. ..... 123/90.15
7,077,087 B2 * 7/2006 Tani ..... 123/90.17
7,107,951 B2 * 9/2006 Urushihata et al. ..... 123/90.17
2006/0124095 A1 * 6/2006 Schafer et al. ..... 123/90.17

OTHER PUBLICATIONS

U.S. Appl. No. 10/510,765, filed Oct. 23, 2003 in the name of Urushihata et al for Variable Valve Timing Control Device of Internal Combustion Engine.

* cited by examiner

*Primary Examiner*—Thomas Denion
*Assistant Examiner*—Kyle M. Riddle
(74) *Attorney, Agent, or Firm*—Nixon & Vanderhye P.C.

(57) ABSTRACT

A variable valve timing controller adjusts valve timing of an intake valve and/or an exhaust valve by varying a motor speed relative to a camshaft. When an engine is running under a predetermined condition, an actual valve timing is calculated based on a cam angle signal and crank angle signal every when the cam angle signal is inputted. A final valve timing is calculated by adding a valve timing variation amount to the actual valve timing at the time the cam angle signal is outputted. The valve timing amount is periodically calculated based on a difference between a motor speed and a rotational speed of the intake camshaft. When the engine is running under another condition, only actual valve timing at the time the cam angle signal is outputted is calculated.

1 Claim, 7 Drawing Sheets

VARIABLE VALVE TIMING CONTROLLER FOR INTERNAL COMBUSTION ENGINE

CROSS REFERENCE TO RELATED APPLICATIONS

This application is based on Japanese Patent Application No. 2004-253176 filed on Aug. 31, 2004, the disclosure of which is incorporated herein by reference.

FIELD OF THE INVENTION

The present invention relates to a variable valve timing controller which varies valve timing of an intake valve and/or an exhaust valve of an internal combustion engine.

BACKGROUND OF THE INVENTION

JP-2001-355462A, which is a counterpart of U.S. Pat. No. 6,405,694B2, shows a variable valve timing controller in which an actual valve timing is calculated based on a crank angle signal and a cam angle signal. A crank angle sensor outputs the crank angle signal every predetermined crank angle, and a cam angle sensor outputs the cam angle signal every predetermined cam angle. However, in this controller, the actual valve timing cannot be calculated during a period from the time when a previous cam angle signal is outputted until the time when the next cam angle signal is outputted. Thus, even though the actual valve timing is continuously varied, the actual valve timing is stepwise updated.

JP-2004-162706A shows another variable valve timing controller in which a driving motor varies a rotational phase of a camshaft relative to a crankshaft in order to adjust a valve timing. In this valve timing controller, an actual valve timing is calculated based on a cam angle signal and a crank angle signal every when the cam angle signal is outputted from the cam angle sensor. A valve timing varying amount is periodically calculated based on a difference between the driving motor speed and the rotational speed of the camshaft. The valve timing varying amount is added to the actual valve timing which is calculated at the time the cam angle signal is outputted in order to derive a final actual valve timing. Thus, even when the cam angle signal is not outputted, the actual valve timing is periodically calculated to enhance an accuracy of the valve timing controller.

However, in this valve timing controller, a calculation load of the controller is increased, because the actual valve timing is always calculated based on the difference in speeds even when the cam angle signal is not outputted.

SUMMARY OF THE INVENTION

The present invention is made in view of the foregoing matter and it is an object of the present invention to provide a variable valve timing controller which accurately controls the valve timing and reduces the calculation load thereof.

A variable valve timing controller includes a crank angle sensor, a cam angle sensor, a valve timing calculation means for calculating an actual valve timing based on the cam angle signal and the crank angle signal every when the cam angle signal is outputted. The controller further includes a periodical valve timing calculation means for periodically calculating a final actual valve timing based on a variation amount of valve timing and the actual valve timing at a time the cam angle signal is outputted, the variation amount of valve timing being periodically calculated based on a difference between an information representing the speed of the motor and an information representing the rotational speed of the camshaft when the internal combustion is running under a predetermined condition.

BRIEF DESCRIPTION OF THE DRAWINGS

The above and other objects, features, and advantages of the present invention will become more apparent from the following detailed description made with reference to the accompanying drawings, in which like parts are designated by like reference number and in which.

DETAILED DESCRIPTION OF THE PREFERRED EMBODIMENTS

Embodiments of the present invention will be described hereinafter with reference to the drawings.

First Embodiment

Referring to FIGS. 1 to 7, a first embodiment will be described hereinafter.

Figure 1:
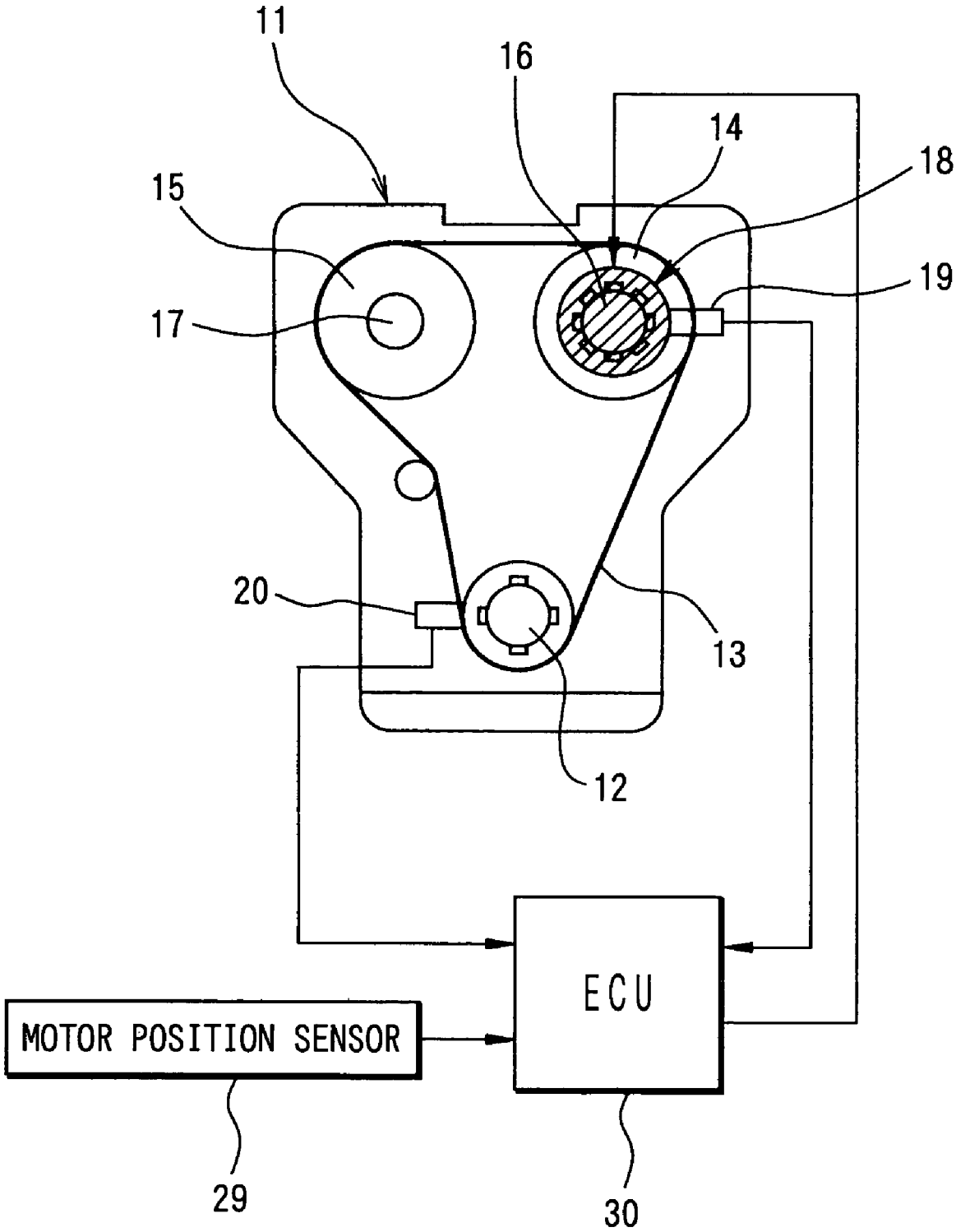
FIG. 1 is a schematic view of an engine control system according to a first embodiment.

FIG. 1 schematically shows a whole structure of an engine control system. An internal combustion engine 11, which is referred to as an engine hereinafter, includes a crankshaft 12. A driving force of the crankshaft 12 is transmitted to an intake camshaft 16 and an exhaust camshaft 17 through a timing chain 13 (or a timing belt) and sprockets 14, 15. A variable valve timing controller 18 is coupled to the intake cam shaft 16. The variable valve timing controller 18 varies a rotational phase (camshaft phase) of the intake camshaft 16 relative to the crankshaft 12 SO that the valve timing of an intake valve (not shown) is adjusted.

A cam angle sensor 19 is provided around the intake camshaft 16. The cam angle sensor 19 outputs a cam angle signal every predetermined cam angle of the intake camshaft 16. A crank angle sensor 20 is provided around the cranks shaft 12. The crank angle sensor 20 outputs a crank angle signal every predetermined crank angle.

Figure 2:
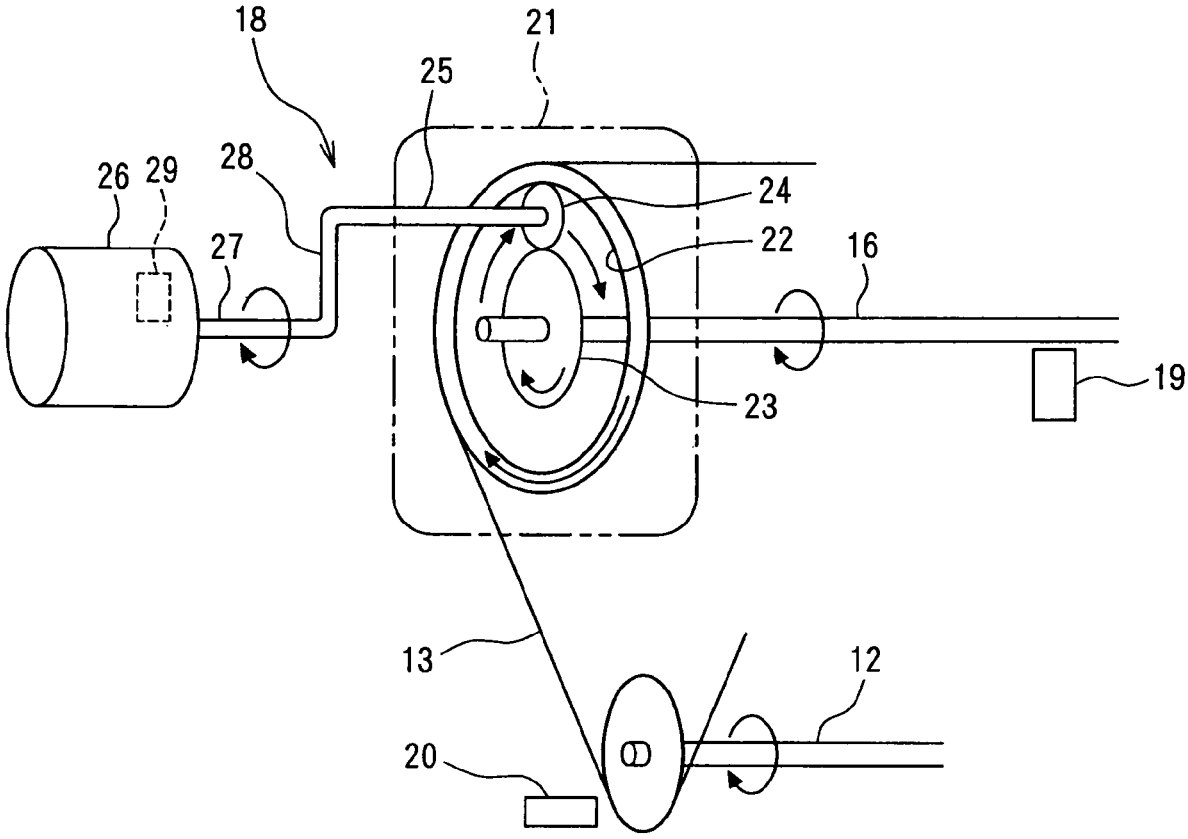
FIG. 2 is a schematic view of a variable valve timing controller.

Referring to FIG. 2, a structure of the variable valve timing controller 18 is described. The variable valve timing controller 18 includes a phase control mechanism 21. The phase control mechanism 21 includes an outer gear 22, an inner gear 23, and a planet gear 24. The outer gear 22 is concentrically arranged with the intake camshaft 16 and has inner teeth. The inner gear 23 is concentrically arranged with the outer gear 22 and has outer teeth. The planet gear 24 is arranged between the outer gear 22 and the inner gear 23 to be engaged with both gears 22, 23. The outer gear 22 rotates integrally with the sprocket 14 which rotates in synchronization with the crankshaft 12, and the inner gear 23 rotates integrally with the intake camshaft 16. The planet gear 24 rotates around the inner gear 23 to transfer a rotation force from the outer gear 22 to the inner gear 23. A rotational phase of the inner gear 23 relative to the outer gar 22 is adjusted by varying a revolution speed of the planet gear 24 relative to the rotation speed of the inner gear 23.

The engine 11 is provided with a motor 26 which varies the revolution speed of the planet gear 24. A rotation shaft 27 of the motor 26 is concentrically arranged with the intake camshaft 16, the outer gear 22, and the inner gear 23. A connecting shaft 28 connects the rotation shaft 27 with a supporting shaft 25 of the planet gear 24. When the motor is energized, the planet gear 24 rotates on the supporting shaft 25 and orbits around the inner gear 23. Besides, the motor 26 is provided with a motor position sensor which outputs a motor angle signal according to a rotational position of the motor 26.

When the motor 26 is not energized, the rotation shaft 27 rotates in synchronization with the intake camshaft 16. That is, when the rotation speed RM of the motor 26 is consistent with the rotational speed RC of the intake camshaft 16, and the revolution speed of the planet gear 24 is consistent with the rotational speed of the inner gear 23, a difference between a rotational phase of the outer gear 22 and a rotational phase of the inner gear 23 is maintained as a current difference to maintain the valve timing as the current valve timing.

When the rotation speed RM of the motor 26 is made higher than the rotational speed RC of the intake camshaft 16, that is, when the revolution speed of the planet gear 24 is made higher than the rotational speed of the inner gear 23, the rotational phase of the inner gear 23 relative to the outer gear 22 is advanced so that the valve timing of the intake valve is advanced.

When the rotation speed RM of the motor 26 is made lower than the rotational speed RC of the intake camshaft 16, that is, when the revolution speed of the planet gear 24 is made lower than the rotational speed of the inner gear 23, the rotational phase of the inner gear 23 relative to the outer gear 22 is retarded so that the valve timing of the intake valve is retarded.

The outputs of the sensors are inputted into an electronic control unit 30, which is referred to as an ECU 30 hereinafter. The ECU 30 includes a microcomputer which executes engine control programs stored in a ROM (read only memory) to control a fuel injection and an ignition timing according to an engine driving condition.

Figure 3:
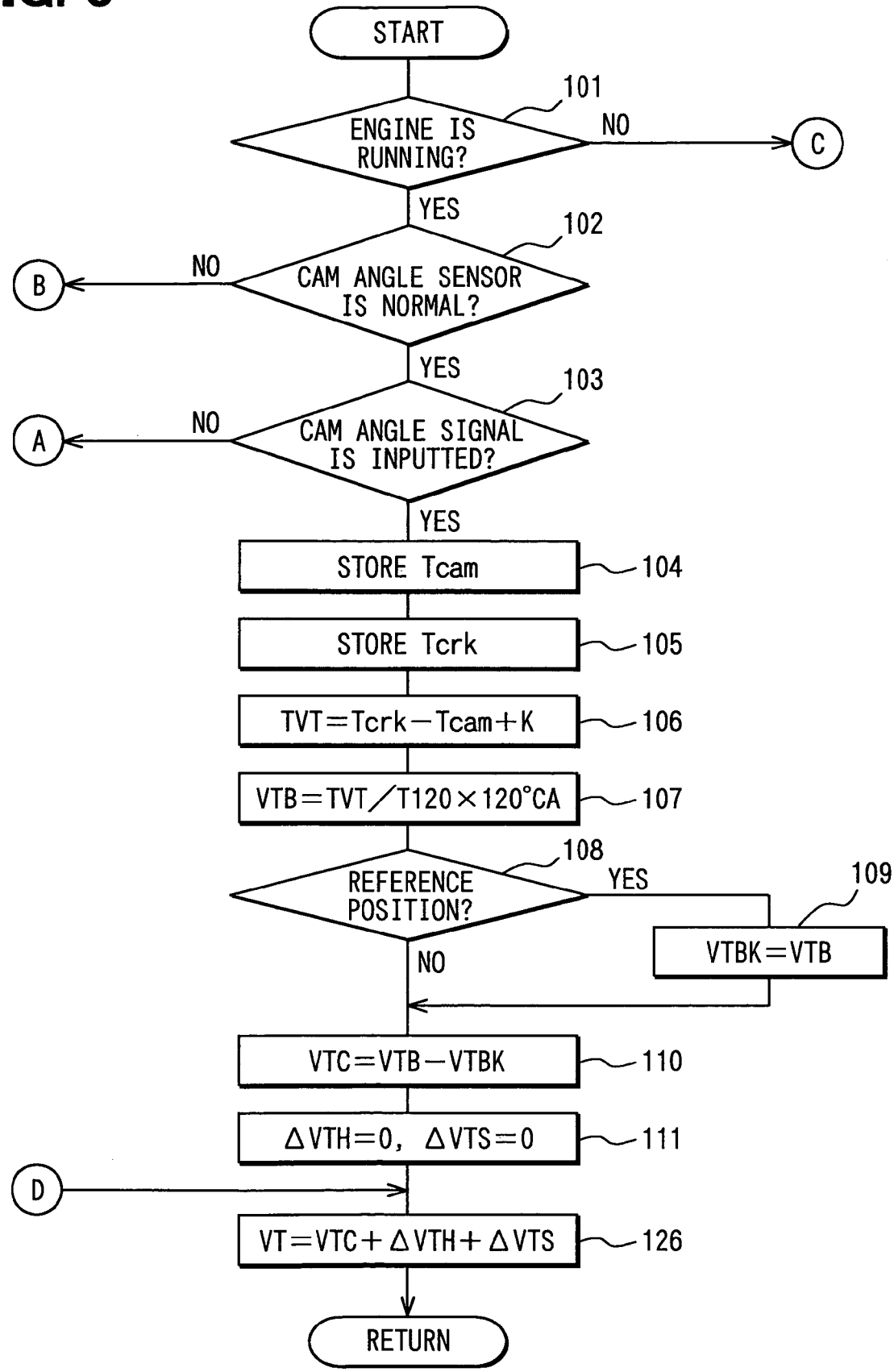
FIG. 3 is a flowchart showing an actual valve timing calculation program.
Figure 4:
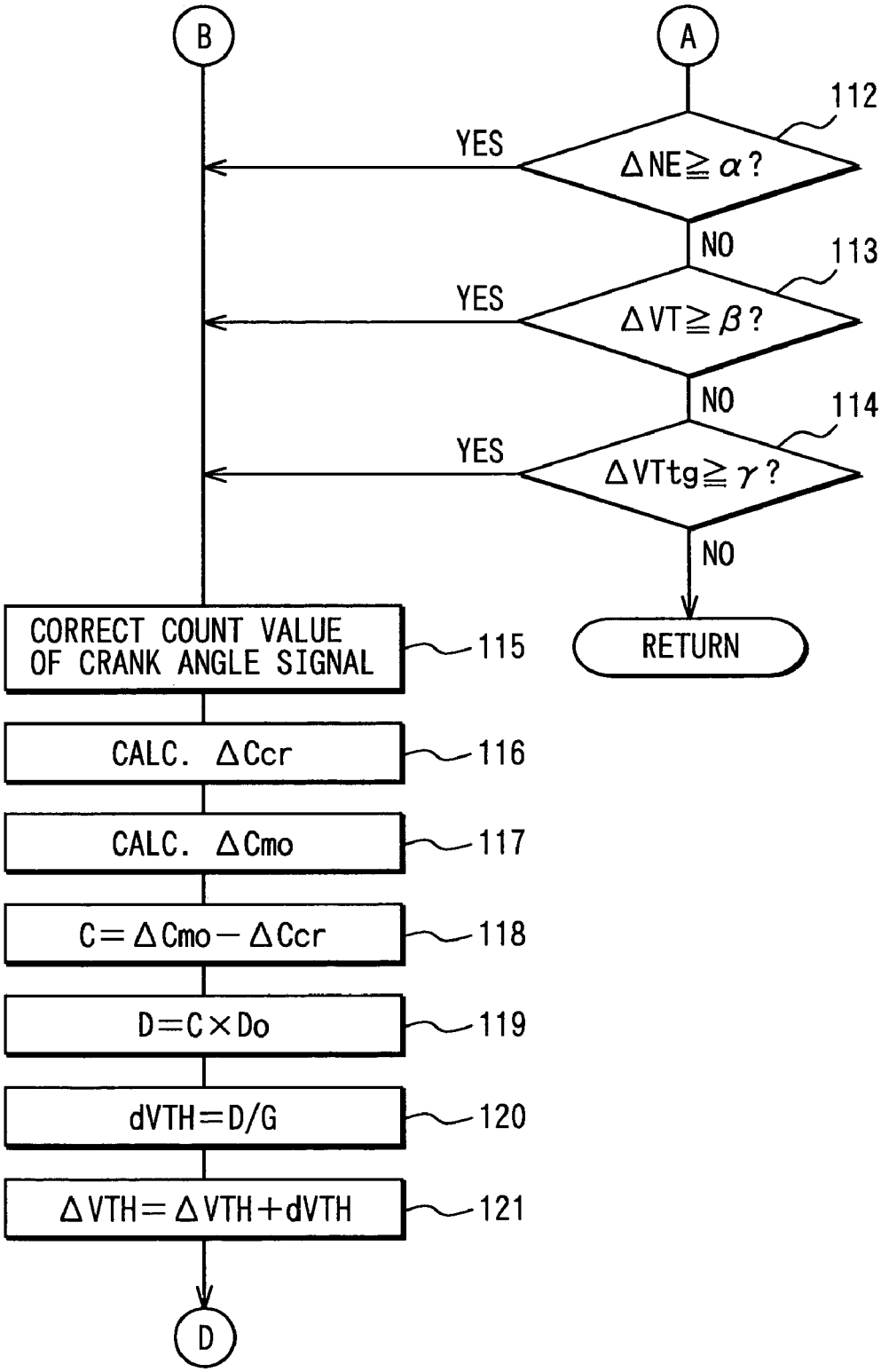
FIG. 4 is a flowchart showing an actual valve timing calculation program.
Figure 5:
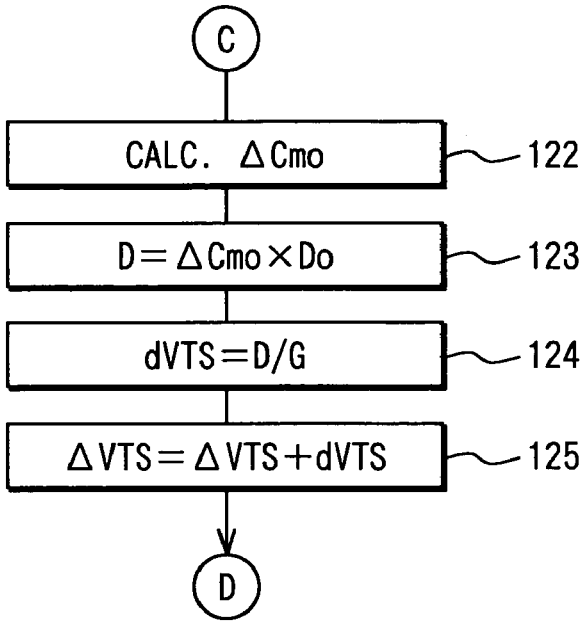
FIG. 5 is a flowchart showing an actual valve timing calculation program.

The ECU 30 controls the motor 26 of the variable valve timing controller so that the actual valve timing of the intake valve coincides with a target valve timing. FIGS. 3 to 5 are flowcharts showing actual valve timing calculation programs.

While the engine 11 is running under a predetermined condition, the actual valve timing VTC is calculated based on the cam angle signal and the crank angle signal every when the cam angle signal is outputted. A valve timing varying amount ΔVT is calculated based on a difference between a rotational speed information of the motor 26 and the rotational speed information of the intake camshaft 16. The valve timing varying amount ΔVT is added to the actual valve timing VTC to obtain a final actual valve timing VT. Thus, even when the cam angle signal is not outputted, the actual valve timing VT is calculated in a predetermined calculating period to enhance controllability of the variable valve timing controller.

In the first embodiment, a motor angle signal outputted from the motor position sensor 29 is counted every when the motor 26 rotates a predetermined angle. A crank angle signal outputted from the crank angle senor 20 is also counted every when the crankshaft 12 rotates a predetermined crank angle. A variation amount ΔCmo of the motor angle signal count value is used as the rotational speed information of the motor 26, and a variation amount ΔCcr of the crank angle signal count value is used as the rotational speed information of the intake camshaft 16.

On the other hand, while the engine 11 is not running under the predetermined condition, no periodical actual valve timing calculation is executed. The actual valve timing is calculated only when the cam angle signal is outputted to reduce a calculation load of the ECU 30.

The actual valve timing calculating program shown in FIGS. 3 to 5 are periodically executed after an ignition switch is turned on. In step 101, a determination is made as to whether the engine 11 is running based on the crank angle signal from the crank angle sensor 20.

When the answer is Yes in step 101, the procedure proceeds to step 102 in which a determination is made as to whether the cam angle sensor 19 is normal according to a cam angle sensor malfunction detecting program.

When the computer determines the cam angle senor 19 is normal (not faulty), the procedure proceeds to step 103 in which a determination is made as to whether the cam angle signal outputted from the cam angle sensor 19 is inputted.

When the answer is Yes in step 103, the procedure proceeds to step 104 in which an input time Tcam of the cam angle signal is stored in a memory (not shown) of the ECU 3O, and then procedure proceeds to step 105 in which an input time Tcrk of the crank angle signal is stored in the memory.

Then, the procedure proceeds to step 106 in which a time difference TVT of the cam angle signal relative to the crank angle signal is calculated based on a following equation.

$$TVT=T\text{crk}-T\text{cam}+K$$

"K" is a correction value to correct a difference in response between the cam angle sensor 19 and the crank angle sensor 20.

In step 107, the rotational phase VTB of the cam angle signal relative to the crank angle signal based on a following equation.

$$VTB=TVT/T120\times 120^\circ\ C.A$$

"T120" is a time period in which the crankshaft 12 rotated 120° CA which is calculated based on the output signal of the crank angle sensor 20.

Then, the procedure proceeds to step 108 in which a determination is made as to whether the valve timing is at a reference position. When the answer is Yes in step 108, the procedure proceeds to step 109 in which a current rotational phase VTB of the cam angle signal relative to the crank angle signal is learned as the reference rotational phase VTBK of the intake camshaft 16 relative to the crankshaft 12. And then, the procedure proceeds to step 110.

$$\text{VTBK}=\text{VTB}$$

When the answer is No in step 108, the procedure proceeds to step 110, skipping step 109.

In step 110, the rotational phase VTC of the cam angle signal relative to the reference rotational phase VTBK is calculated based on the current rotational phase VTB of the cam angle signal. The rotational phase VTC of the cam angle signal is defined as the actual valve timing VTC at the time the cam angle signal is outputted.

$$VTC=VTB-VTBK$$

The procedures in steps 103 to 110 serve as a valve timing calculating means at the time the cam angle signal is outputted. The actual valve timing VTC is calculated every when the cam angle signal is inputted.

Then, the procedure proceeds to step 111 in which both the valve timing varying amounts ΔVTH and ΔVTS are reset to "0" every when the actual valve timing VTC at the time the cam angle signal is outputted is calculated. And then, the procedure proceeds to step 126 in which the final actual valve timing VT is calculated according to a following equation.

$$VT=VTC+\Delta VTH+\Delta VTS$$

At the time of cam angle signal inputting, since it is ΔVTH=0, ΔVTS=0 in step 111, it is VT=VTC.

Meanwhile, the answer is No in step 103, a determination is made as to whether the periodical actual valve timing calculating condition is established in steps 112 to 114 in FIG. 4.

The periodical actual valve timing calculating condition includes following conditions.

(1) A variation amount ΔNE of the engine speed NE per a predetermined period is more than or equal to a predetermined value α (step 112).

(2) A variation amount ΔVT of the actual valve timing VT per a predetermined period is more than or equal to a predetermined value β (step 113).

(3) A variation amount ΔVTtg of the target valve timing VTtg per a predetermined period is more than or equal to a predetermined value γ (step 114).

When at least one of above conditions is satisfied, the periodical actual valve timing calculating condition is established. When the computer determines that the periodical actual valve timing calculating condition is not established, the procedure ends without executing steps 115 and following steps.

When the periodical actual valve timing calculating condition is established, the procedure proceeds to step 115 in which the count value of the crank angle signal (or the count value of the motor angle signal) is corrected. Thereby, even if output number of the crank angle signal per two rotation of the crankshaft 12 is different from the output number of the motor angle signal per one rotation of the motor 26, these count numbers are brought to be the same number.

Then, the procedure proceeds to step 116 in which a variation amount ΔCcr of the crank angle signal count number, which is data having a correlation with a rotational angle varying amount of the intake camshaft 16, based on the following equation.

$$\Delta Ccr=Ccr(i)-Ccr(i-1)$$

Here, Ccr (i) is a current count number of the crank angle signal, and Ccr (i−1) is a previous count number of the crank angle signal.

Then, the procedure proceeds to step 117 in which a variation amount ΔCmo of the motor angle signal count number, which is data having a correlation with a rotational angle varying amount of the motor 26, based on the following equation.

$$\Delta Cmo=Cmo(i)-Cmo(i-1)$$

Here, Cmo (i) is a current count number of the motor angle signal, and Cmo (i−1) is a previous count number of the motor angle signal.

Then the procedure proceeds to step 118 in which a difference "C" between the variation amount ΔCmo and the variation amount ΔCcr $$C=\Delta Cmo-\Delta Ccr$$

Then, the procedure proceeds to step 119 in which the difference "C" is converted into a rotational angle varying amount "D" of the motor 26 relative to the intake camshaft 16 according to a following equation.

$$D=C\times D0$$

Here, D0 is a conversion coefficient, which corresponds to a rotational angle varying amount of the motor 26 relative to the intake camshaft 16 when the difference "C" is one count.

In step 120, the rotational angle varying amount "D" is converted into a variable valve timing varying amount dVTH per a calculating period according to a following equation.

$$dVTH=D/G$$

Here, "G" is a reduction ratio of the phase adjusting mechanism 21, which corresponds to a ratio between a relative rotation amount of the motor 26 relative to the intake camshaft 16 and the valve timing varying amount (varying amount of the camshaft phase).

Then, the procedure proceeds to step 121 in which the variable valve timing varying amount dVTH is integrated to drive the valve timing varying amount ΔVTH after an updated cam angle signal is outputted.

$$\Delta VTH=\Delta VTH+dVTH$$

Also when the computer determines that the cam angle sensor 19 is faulty in step 102, the procedure in steps 115 to 121 are performed to integrate the valve timing varying amount dVTH per one calculation period to derive the valve timing varying amount ΔVTH during a period from the time the cam angle sensor 19 is still normal to the time final cam angle signal is outputted before the cam angle sensor becomes faulty.

After the valve timing varying amount ΔVTH is calculated, the procedure proceeds to step 126 in FIG. 3 in order to calculate the final actual valve timing VT according to following equation.

$$VT=VTC+\Delta VTH+\Delta VTS$$

When the cam angle sensor 19 is faulty, ΔVTS is zero, so that it is established that VT=VTC+ΔVTH. The procedures in steps 112 to 121, and 126 correspond to a periodical valve timing calculation means.

In step 101, the computer determines the engine 11 is not running, the procedure proceeds to step 122 in which a variation amount ΔCmo of count value of the motor angle signal according to a following equation.

$$\Delta Cmo=Cmo(i)-Cmo(i-1)$$

Then, the procedure proceeds to step 123 the variation amount ΔCmo is converted into the rotational angle varying amount D of the motor 26 based on the following equation.

$$D=C\times D0$$

In step 124, the rotational angle varying amount "D" is converted into a valve timing varying amount dVTS per a calculating period according to a following equation.

$$dVTS=D/G$$

Then, the procedure proceeds to step 125 in which the valve timing varying amount dVTS is integrated to drive the valve timing varying amount ΔVTS during a period from the time when the final cam angle signal outputted before the engine stops until present time.

$$\Delta VTS=\Delta VTS+dVTS$$

After the valve timing varying amount ΔVTS is calculated, the procedure proceeds to step 126 in which the final actual valve timing VT is calculated according to a following equation.

$$VT=VTC+\Delta VTH+\Delta VTS$$

While the engine is not running, ΔVTH is zero, so that it is established that VT=VTC+ΔVTS.

Alternatively, when the engine is not running or when the cam angle sensor 19 is faulty, the actual valve timing may be calculated based on a mechanical reference position such as the most retarded position or a reference position detected by another detecting means.

According to the first embodiment, when the driving condition is a predetermined condition, the actual valve timing calculation at the time the cam angle is outputted is executed, and the periodical actual valve timing calculation is executed based on the rotational information of the motor 26 and the intake camshaft 16. That is, when the variation amount ΔNE of the engine speed NE per a predetermined period is larger than a preset value as shown by an arrow "A" in FIG. 6A, when the variation amount ΔVT of the actual valve timing VT is larger than a preset value as shown by an arrow "A" in FIG. 6B, or when the variation amount ΔVTtg of the target valve timing VTtg is larger than a preset value as shown by an arrow "A" in FIG. 6C, the above calculation is executed.

Figure 7:
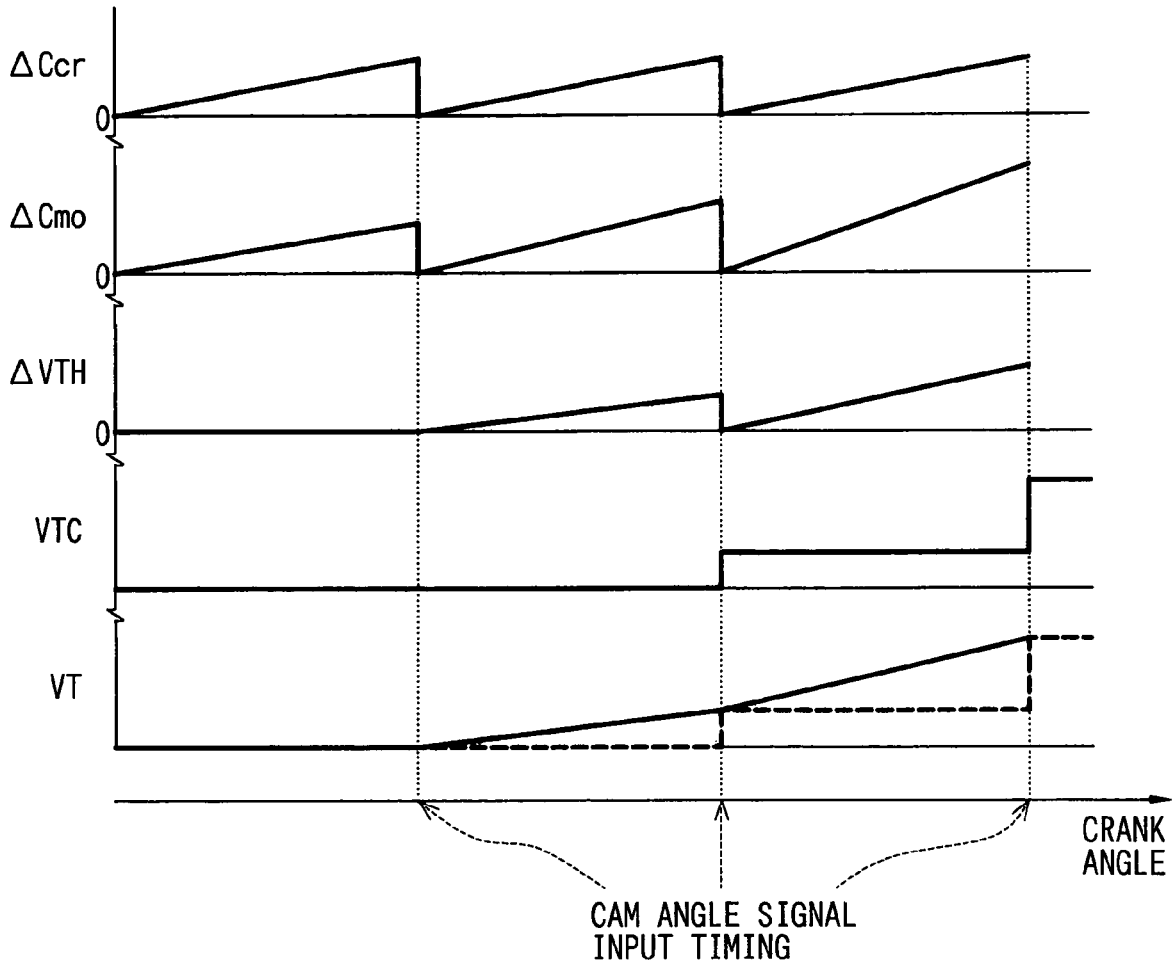
FIG. 7 is a time chart for explaining the actual valve timing calculation according to the first embodiment.

Specifically, as shown in FIG. 7 which is a time chart, the actual valve timing VTC is calculated based on the cam angle signal and the crank angle signal every when the cam angle signal is inputted while the engine is running. When the cam angle signal is inputted (outputted), the actual valve timing VTC at the time of cam angle signal outputting becomes the final actual valve timing VT. Meanwhile, the cam angle signal is not inputted, the valve timing varying amount dVTH per the calculation period is calculated based on the difference "C" (=ΔCmo−ΔCcr) between the motor angle signal and variation amount of the count value of the crank angle signal. The valve timing varying amount dVTH is integrated to derive the valve timing varying amount ΔVTH. Then, the valve timing varying amount ΔVTH is added to the updated actual valve timing VTC in order to derive the final actual valve timing VT.

When the engine is running under a transient condition, the periodical actual valve timing calculation is performed, so that the actual valve timing VT can be calculated in a predetermined time period to enhance the controllability of the variable valve timing controller.

Figure 6A:
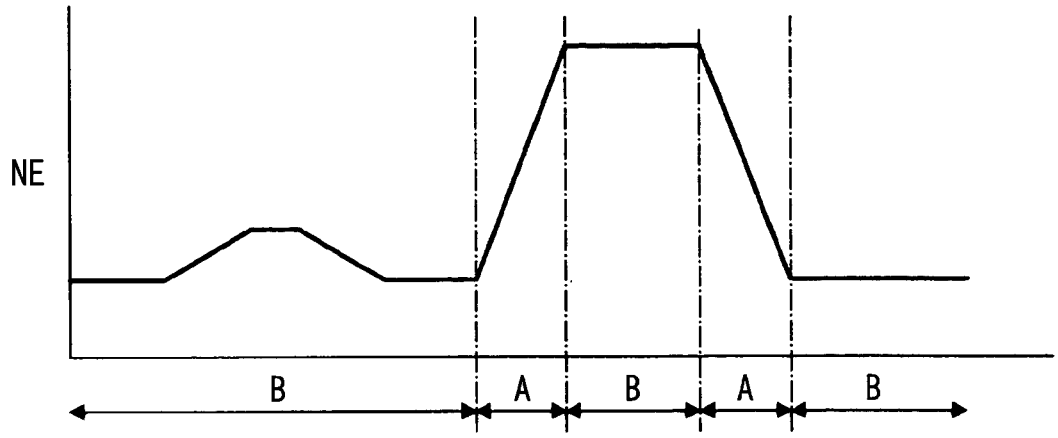
FIG. 6A to 6C are time charts for explaining a way of an actual valve timing calculation according to the first embodiment.
Figure 6B:
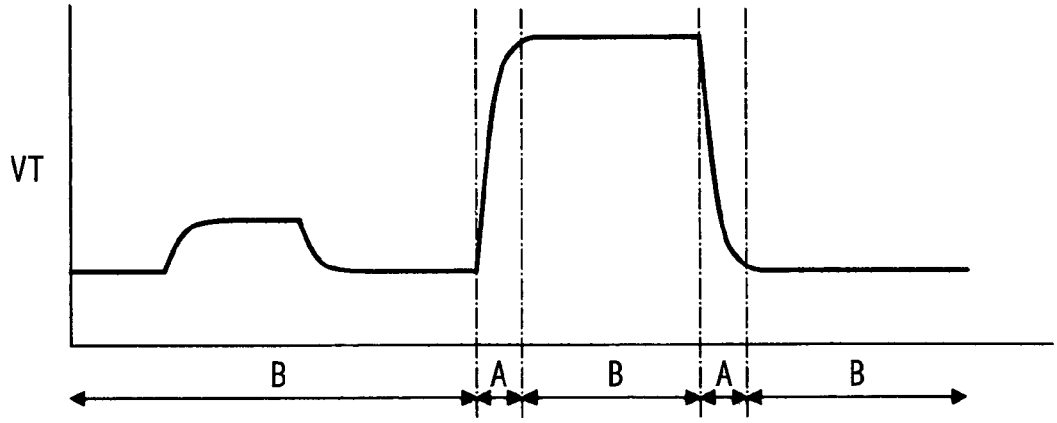
Figure 6C:
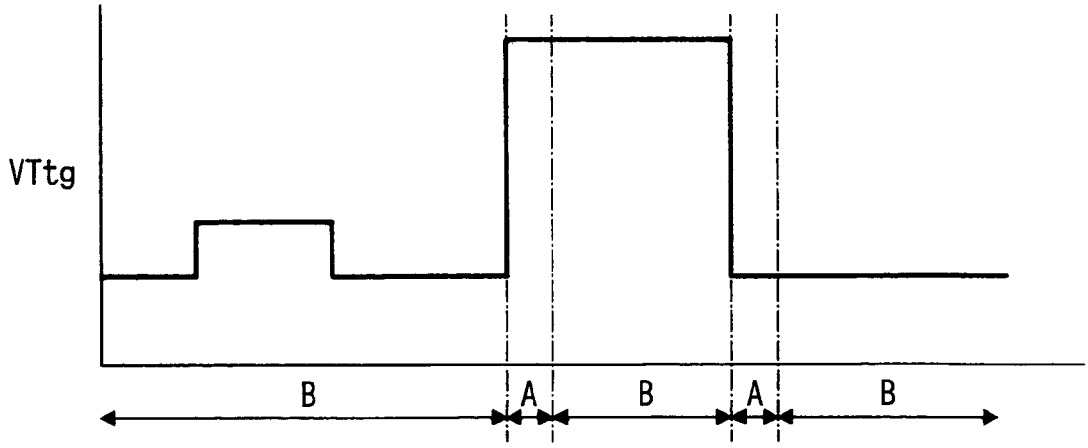

While the driving condition is out of the predetermined condition as shown by an arrow "B" in FIGS. 6A to 6B, the periodical actual valve timing calculation is not conducted but the actual valve timing calculation at the time the cam angle signal is outputted is conducted.

Thus, when the variation amounts of the engine speed NE, the actual valve timing VT, and the target valve timing VTtg are relatively small, the actual valve timing calculation at the time of the cam angle signal is outputted is conducted to reduce the calculating load of the ECU 30.

Second Embodiment

Figure 8:
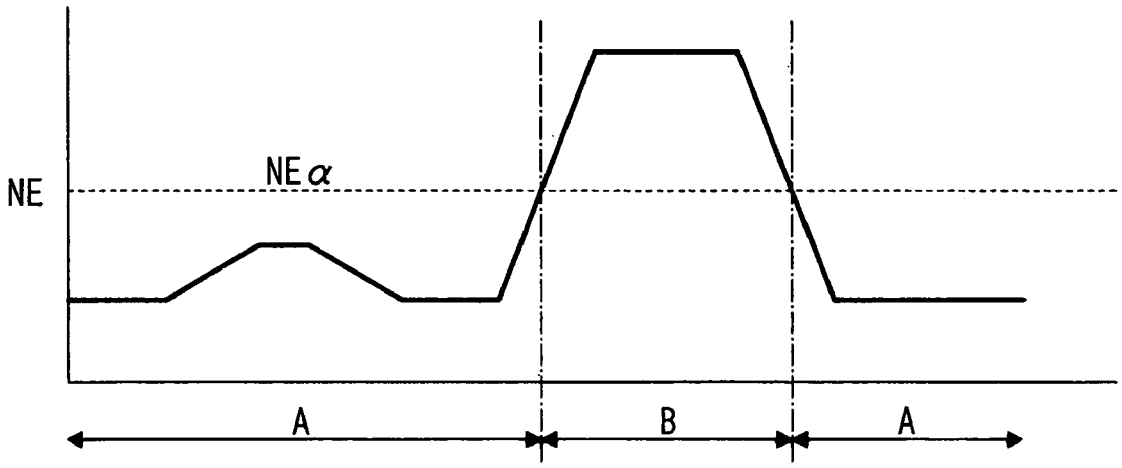
FIG. 8 is a time chart for explaining a way of an actual valve timing calculation according to a second embodiment.

Referring to FIG. 8, a second embodiment is described hereinafter.

Generally, according as the engine speeds NE is decreased, a calculation period of each control program increases to reduce the calculation amount per a predetermined period.

When the engine speed NE is under a predetermine value NEα as shown by an arrow "A" in FIG. 8, both the actual valve timing calculation at the time the cam angle signal is outputted and the periodical actual valve timing calculation are conducted. When the engine speed NE is over the predetermined value NEα as shown by an arrow "B" in FIG. 8, only the actual valve timing calculation at the time the cam angle signal is outputted is conducted.

According to the second embodiment, when the engine speed NE is low, the periodical valve timing calculation is conducted to restrict the calculation load of the ECU 30, and when the cam angle signal is not outputted, the actual valve timing is calculated in a predetermined time period to enhance the accuracy of the variable valve timing control.

According to the first and the second embodiment, the valve timing varying amount ΔVT is calculated based on the count value of the motor angle signal and the crank angle signal. Alternatively, the valve timing varying amount ΔVT may be calculated based on a difference between the variation amount of the motor angle signal and the variation amount of the crank angle signal. The valve timing varying amount ΔVT may be calculated based on a difference between the rotational speed of the motor 26 and the rotational speed of the intake camshaft 16.

The phase adjust mechanism of the variable valve timing controller is not limited to the planetary gear mechanism.

What is claimed is:

1. A variable valve timing controller adjusting a valve timing of an intake valve and/or an exhaust valve by varying a speed of a driving motor relative to a rotational speed of a camshaft in such a manner as to vary a rotational phase of the camshaft relative to a crankshaft of an internal combustion engine, the variable valve timing controller comprising:

a crank angle sensor outputting a crank angle signal every predetermined crank angle;

a cam angle sensor outputting a cam angle signal every predetermined cam angle;

valve timing calculation circuitry for calculating an actual valve timing based on the cam angle signal and the crank angle signal every when the cam angle signal is outputted; and periodical valve timing calculation circuitry for periodically calculating a final actual valve timing based on a variation amount of valve timing and the actual valve timing at a time the cam angle signal is outputted, the variation amount of valve timing being periodically calculated based on a difference between information representing the speed of the motor and information representing the rotational speed of the camshaft only when the internal combustion is running under a transient condition so that the valve timing calculation circuitry performs calculation of the actual valve timing but the periodical valve timing calculation circuitry does not perform calculation of the final actual valve timing when the internal combustion engine is not running under the transient condition.

* * * * *